US008656653B1

(12) United States Patent
O'Malia et al.

(10) Patent No.: US 8,656,653 B1
(45) Date of Patent: Feb. 25, 2014

(54) BUILDING FOUNDATION CONSTRUCTION AND METHODS

(71) Applicant: GO Logic, L.L.C., Belfast, ME (US)

(72) Inventors: Matthew O'Malia, Belfast, ME (US); Alan Gibson, Waldo, ME (US)

(73) Assignee: GO Logic, L.L.C., Belfast, ME (US)

( * ) Notice: Subject to any disclaimer, the term of this patent is extended or adjusted under 35 U.S.C. 154(b) by 0 days.

(21) Appl. No.: 13/907,025

(22) Filed: May 31, 2013

Related U.S. Application Data

(60) Provisional application No. 61/723,461, filed on Nov. 7, 2012.

(51) Int. Cl.
*E04B 1/00* (2006.01)

(52) U.S. Cl.
USPC ..... 52/169.11; 52/294

(58) Field of Classification Search
USPC ..... 52/292, 293.1, 294, 299, 169.11
See application file for complete search history.

(56) References Cited

U.S. PATENT DOCUMENTS

| | | | | |
|---|---|---|---|---|
| 3,673,750 | A * | 7/1972 | Bokvist et al. | 52/169.11 |
| 3,798,858 | A * | 3/1974 | Turner | 52/169.11 |
| 4,320,604 | A * | 3/1982 | O'Hanlon | 52/93.2 |
| 4,335,548 | A * | 6/1982 | Rehbein | 52/169.11 |
| 4,524,553 | A * | 6/1985 | Hacker | 52/169.11 |
| 6,238,766 | B1 * | 5/2001 | Massett et al. | 428/99 |
| 6,546,679 | B1 * | 4/2003 | Bushberger | 52/169.14 |
| 7,313,891 | B2 * | 1/2008 | Showers | 52/267 |
| 7,407,004 | B2 * | 8/2008 | Kugemoto | 165/45 |
| 7,735,271 | B1 * | 6/2010 | Shipston et al. | 52/169.11 |
| 8,011,144 | B2 * | 9/2011 | Compton | 52/169.11 |
| 8,209,915 | B2 * | 7/2012 | O'Leary et al. | 52/62 |
| 8,375,677 | B1 * | 2/2013 | Weiler | 52/745.1 |
| 2004/0040227 | A1 * | 3/2004 | Tozaka et al. | 52/169.14 |
| 2007/0022677 | A1 * | 2/2007 | Richardson | 52/169.1 |

* cited by examiner

*Primary Examiner* — Mark Wendell
(74) *Attorney, Agent, or Firm* — MacMillan, Sobanski & Todd, LLC

(57) ABSTRACT

A building foundation having a plurality of insulating members arranged to define a perimeter that acts as a form for concrete is described. Concrete is poured into the form in a non-rigid state and allowed to harden into a concrete slab integrally formed with the plurality of insulating members.

20 Claims, 3 Drawing Sheets

BUILDING FOUNDATION CONSTRUCTION AND METHODS

RELATED APPLICATIONS

This application claims priority to U.S. Provisional Application Ser. No. 61/723,461, filed Nov. 7, 2012, the disclosure of which is incorporated herein by reference in its entirety.

TECHNICAL FIELD

The invention relates to concrete slab insulation for the foundation of a building. More particularly, the invention pertains to a method of constructing a building foundation using insulating members to insulate a concrete slab underlying a building. The invention also relates to a method of mitigating heat loss from a building into the ground.

BACKGROUND OF THE INVENTION

Many buildings, such as houses, are designed to be insulated in order to conserve energy, make use of passive heating and cooling, and minimize the cost and complexity of mechanical systems. One way of insulating a structure is to insulate the shell of the structure during construction.

The methods of insulating the shell of a structure during construction known in the art include installing insulating material underneath or abutting the foundation. However, these methods require a significant amount of labor and vertical bracing to complete. It would be advantageous to build homes and other buildings through a process which results in the buildings being better insulated and more energy efficient while still minimizing the cost and labor required to build them.

SUMMARY OF THE INVENTION

In a first broad aspect, described in the present specification is a building foundation having a plurality of insulating members arranged on a surface to define a perimeter. Each insulating member is made of an insulating substance and has a vertical arm and a horizontal arm, with each arm having an elongated cross section that defines major faces. The vertical arm is oriented vertically relative to the surface, and the horizontal arm is oriented horizontally relative to the surface. The building foundation further includes a concrete slab disposed within the perimeter.

In another broad aspect, described in the present specification is a method of constructing a building foundation. The method involves arranging a plurality of insulating members on a surface to define a perimeter, with each insulating member being made of an insulating substance and having a vertical arm and a horizontal arm, each arm having an elongated cross section that defines major faces. The vertical arm is oriented vertically relative to the surface, and the horizontal arm is oriented horizontally relative to the surface. The method further includes pouring concrete into the perimeter in a non-rigid state, and allowing the concrete to harden, thereby forming a monolithic slab integrated into the plurality of insulating members.

In another broad aspect, described in the present specification is a member for insulating a building foundation. The member has a vertical arm and a horizontal arm that are arranged at an angle $\alpha$ to each other within the range of from about 80 degrees to about 100 degrees. The member is made of an insulating foam substance, and each arm has an elongated cross section that defines major faces. The vertical arm and the horizontal arm are integrally formed together such that when arranged on a surface to define a portion of a perimeter of a foundation, the vertical arm is sufficiently connected to the horizontal arm in order to enable the member to act as a form for receiving unformed concrete being poured into the form.

DETAILED DESCRIPTION OF THE INVENTION

Various embodiments are described in the present disclosure in the context of insulated foundations and methods of insulating foundations. Those of ordinary skill in the art will realize that the following detailed description of the embodiments is illustrative only and not intended to be in any way limiting. Other embodiments will readily suggest themselves to such skilled persons having the benefit of this disclosure. Reference to an "embodiment," "aspect," or "example" in this disclosure indicate that the embodiments of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

The method and product of the present invention pertain to constructing insulated buildings such as homes. A typical building foundation 12 has a concrete slab 32 that bears directly on the soil. The concrete allows for heat loss into the ground because concrete is a poor insulator. The present invention minimizes the problem of heat loss by incorporating insulating members 10 into the foundation 12, encircling the perimeter 14 of the concrete foundation 12. The insulating members 10 provide insulation both under a perimeter 14 of the concrete slab 32 and surrounding the concrete slab 32. The result is a foundation 12 encapsulated in insulating material and mostly isolated from the ground.

Figure 1:
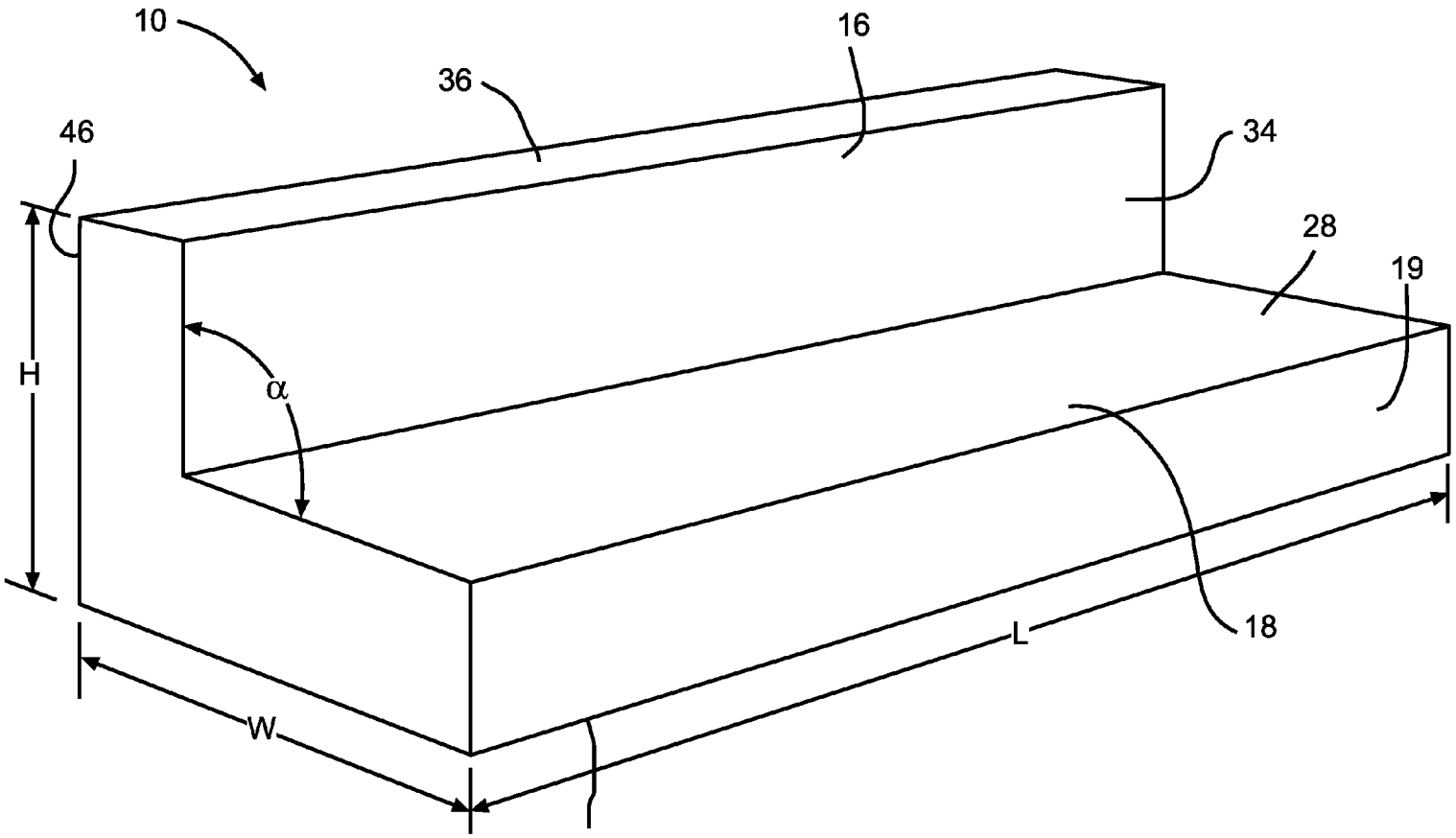
FIG. 1 is perspective view of an insulating member.

In certain embodiments, the insulating members 10 used to encircle the foundation 12 have a vertical arm 16 and a horizontal arm 18, each arm having an elongated cross section defining major faces 19, 21, 28, 34, 36, 46. As seen in FIG. 1, a cross section of the members 10 can generally resemble an "L" shape. In particular embodiments, the horizontal arm 18 is thicker than the vertical arm 16. In particular embodiments, the horizontal arm 18 is longer than the vertical arm 16. The members 10 can be one of many different sizes. By way of non-limiting example, the length L of the members 10 can be about 8 feet, the width W of the members 10 can be about 4 feet, and the height H of the members 10 can be within the range of from about 20 inches to about 36 inches. Other variations and dimensions are possible.

The insulating members 10 generally comprise an insulating substance. In certain embodiments, the insulating substance 20 has an R value of at least about 0.35 $m^2 \cdot K/(W \cdot in)$, or more particularly, at least about 0.65 $m^2 \cdot K/(W \cdot in)$. In certain embodiments, the insulating substance 20 comprises an insulating foam. In particular embodiments, the insulating substance 20 is expanded polystyrene foam (EPS). By way of non-limiting example, the insulating substance 20 can be EPS 39 or EPS 46. Other insulating substances and foams are possible.

Figure 3:
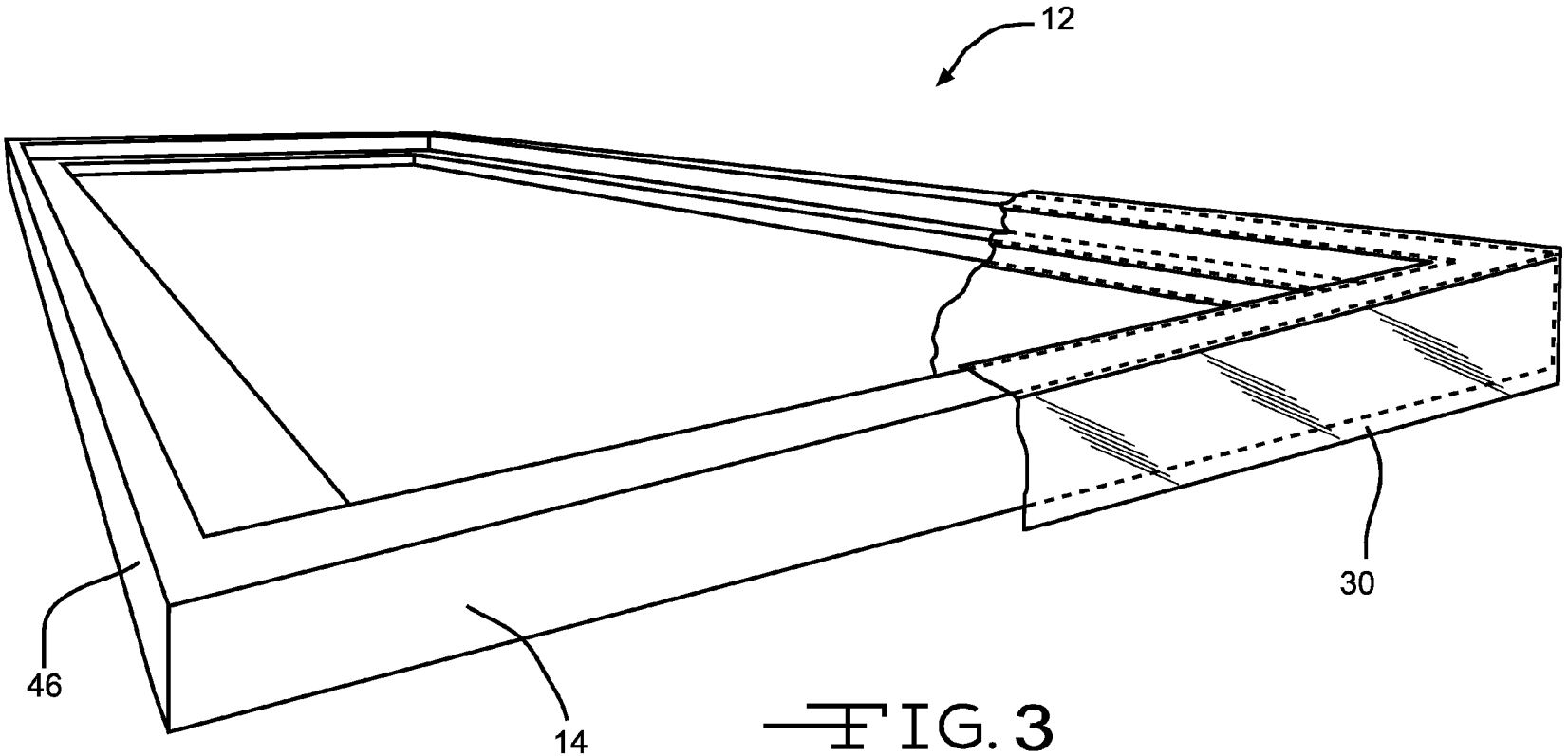
FIG. 3 is a top-down view of insulating members arranged to define a perimeter.

In accordance with the present disclosure, the insulating members 10 are generally arranged to define a perimeter 14 for the building foundation 12, as shown in FIG. 3, with the vertical arms 16 extending upwards from the ground and the horizontal arms 18 extending inwardly from the perimeter 14. The corners of the foundation 12 can be formed ahead of time or configured on-site by cutting and sizing the members 10 in the desired manner. Once the insulating members 10 are arranged to define a perimeter 14, the outer face 46 of the vertical arms forms an outer wall of the perimeter 14. Because the members 10 have arms 16, 18 fixed at an angle to each other, the perimeter 14 formed by this arrangement has no butt joints between the vertical arms 16 and the underlying horizontal arms 18, thereby providing better insulation to the foundation 12. Furthermore, the fact the arms 16, 18 are fixed at an angle to each other allows for quicker and more efficient construction because it eliminates or minimizes the need for vertical bracing.

Figure 2:
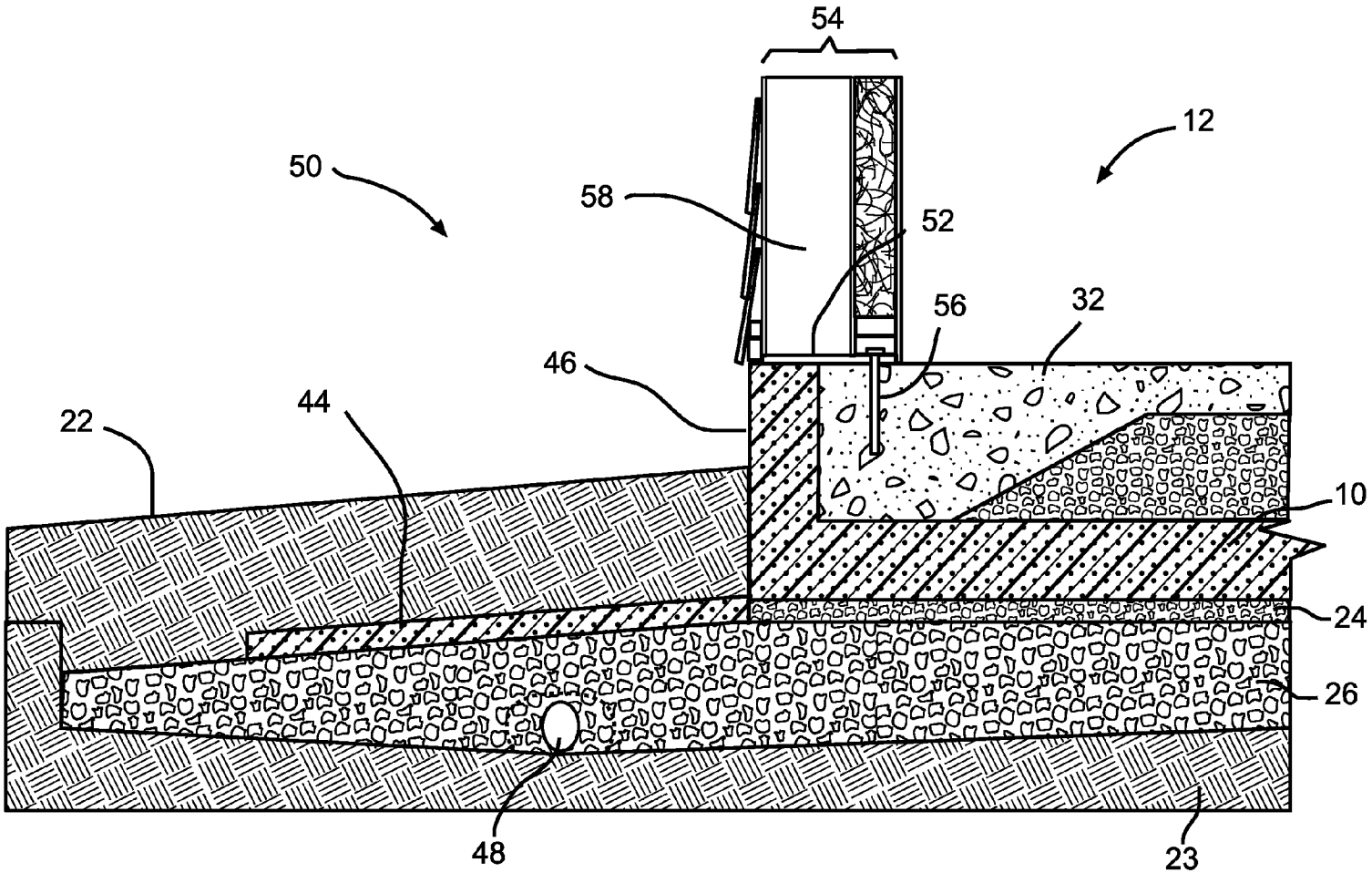
FIG. 2 is a cross-sectional view of a building foundation incorporating an insulating member.

As shown in FIG. 2, the foundation 12 of a building 50 is constructed on a surface such as soil 23, which may include a grade 22. In certain embodiments, the foundation 12 further includes a layer of flowable fill 24 underneath the perimeter 14 of insulating members 10. The flowable fill 24 may be compacted crushed stone dust or any other suitable material. In certain embodiments, the flowable fill 24 is disposed on top of a layer of structural fill 26, which is a mixture of clean gravel and sand. In certain embodiments, the structural fill 26 is disposed beneath the perimeter 14, within and/or outside of the perimeter 14. Other underlayments can be used. By way of non-limiting example, the gravel may be disposed within the perimeter 14 defined by the insulating members 10, at least partially on the top face 28 of the horizontal arms 18. By way of further non-limiting example, a vapor barrier 30 may be disposed within the perimeter 14 to cover the top face 28 of the horizontal arms 18 prior to pouring the concrete for the concrete slab 32. In particular embodiments, a vapor barrier 30 also covers the inner face 34 and the top face 36 of the vertical arms 16.

After the insulating members 10 have been arranged to define a perimeter 14 for the foundation 12, concrete for the concrete slab 32 is poured in a non-rigid state into the perimeter 14. The concrete is allowed to harden, forming a monolithic, cast slab 32 effectively encapsulated or surrounded by, and integrally incorporated into, the perimeter 14 of insulating members 10. The vertical arm 16 can act as the form for the poured concrete. In particular embodiments, a metal flashing (not shown) and water shield (not shown) are placed between the soil and the vertical arms 16. In certain embodiments, a temporary wood form (not shown) for flowable fill 24 is inserted into the soil adjacent to the outer wall 46 of the perimeter 14, and is removed before the concrete hardens. In certain embodiments, rigid insulation 44 is installed within the structural fill 26, extending beyond the outer wall 46 of the perimeter 14, so as to further insulate the foundation 12. By way of non-limiting example, the rigid insulation 44 may extend a distance within the range of from about three feet to about five feet from the outer wall 46 of the perimeter 14. In certain embodiments, a vapor barrier 30 is installed between the concrete slab 32 and the members 10, where the vertical arms 16 meet the horizontal arms 18. In certain embodiments, a drain 48 for the perimeter 14 is installed in the structural fill 26 to the side of the perimeter 14. The drain 48 extends through the structural fill 26 to allow the draining of fluids, such as water, away from the foundation 12.

Referring now to FIG. 2, a building 50 constructed with the insulated foundation 12 of the present disclosure includes building material disposed within, and on top of, the foundation 12. In certain embodiments, a sill plate 52 is disposed on top of the concrete slab 32 adjacent to the vertical arms 16 of the insulating members 10, and a wall structure 54 is erected on the sill plate 52. In particular embodiments, stud walls packed with insulating material are erected on top of the sill plate 52 and are stabilized by any suitable fastener 56, such as galvanized J-bolts, protruding upwards from the foundation 12. A structural insulating panel 58 can be disposed directly above the vertical arms 16 of the insulating members 10. Insulating foam (not shown) may be sprayed at the joint between the vertical arms 16 and the wall panel or structural insulating panel 58. In this manner, a building 50 can be constructed within a continuous layer of insulation. Other embodiments can be used to attach wall structures 54. In particular embodiments, a vapor barrier 30 is installed above the perimeter 14, along the bottom of the walls erected on the sill plate 52.

By way of non-limiting example, the vertical arm 16 of the insulating members 10 is about six inches thick and the horizontal arm 18 is about eight inches thick. By way of further non-limiting example, the vertical arm 16 measures about one-foot eight-inches from the top to the bottom of the outer wall 46. In these examples, the edge of the concrete slab 32 is adjacent to at least six inches of insulating material in both the outward and downward directions. Other dimensions are possible. For example, additional insulating material may extend inwardly from the perimeter 14. In particular embodiments, additional insulating material extends underneath the entire concrete slab 32. It is to be understood that the insulating members 10 need not be made of a foam material, but can also be made of other insulating materials, such as, but not limited to, fiber glass or wood fiber materials.

Construction of a building foundation 12 as described reduces the amount of labor required compared to conventional methods, requires no vertical bracing, and results in a foundation 12 with greater insulation and bearing capacity.

While the invention has been described with reference to multiple embodiments, it should be understood by those skilled in the art that various changes may be made and equivalents may be substituted without departing from the essential scope of the invention. In addition, many modifications may be made to adapt a particular situation or material to the teachings of the invention without departing from its essential scope. Therefore, it is intended that the invention not be limited to the particular embodiments disclosed in the present specification, but that the invention will include all embodiments falling within the scope of the claims.

What is claimed is:

1. A building foundation comprising:

a plurality of insulating members arranged on a surface to define a perimeter, each insulating member comprising an insulating substance and having a vertical arm and a horizontal arm, wherein each arm has an elongated cross section defining major faces; and a concrete slab disposed within the perimeter;

wherein the horizontal arms are longer and thicker than the vertical arms.

2. The building foundation of claim 1, wherein the concrete slab is integrally formed with the plurality of insulating members.

3. The building foundation of claim 1, wherein the insulating substance comprises a foam.

4. The building foundation of claim 1, wherein the insulating substance comprises expanded polystyrene.

5. The building foundation of claim 1, wherein the horizontal arms of the insulating members extend underneath the entire concrete slab.

6. The building foundation of claim 1, wherein a vapor barrier is disposed between the insulating members and the concrete slab.

7. The building foundation of claim 1, further comprising a sill plate and wall structure disposed on top of the concrete slab.

8. The building foundation of claim 1, further comprising:

flowable fill disposed beneath the plurality of insulating members; and structural fill beneath the flowable fill.

9. The building foundation of claim 8, further comprising rigid insulation disposed adjacent to the flowable fill, extending beyond the perimeter.

10. The building foundation of claim 1, further comprising gravel disposed between the plurality of insulating members and the concrete slab.

11. A method of constructing a building foundation comprising:

arranging a plurality of insulating members on a surface to define a perimeter, wherein each insulating member comprises an insulating substance and has a vertical arm and a horizontal arm, and each arm has an elongated cross section defining major faces;

installing a vapor barrier over the plurality of insulating members;

pouring concrete into the perimeter in a non-rigid state; and allowing the concrete to harden, forming a concrete slab integrated into the plurality of insulating members.

12. The method of claim 11, further comprising the steps of:

laying structural fill on top of the surface before arranging the plurality of insulating members to define a perimeter;

placing flowable fill on top of the structural fill; and and arranging the plurality of insulating members to define a perimeter on top of the flowable fill.

13. The method of claim 11, wherein the insulating substance comprises expanded polystyrene foam.

14. The method of claim 11, further comprising the step of installing metal flashing and a water shield along the outer wall of the perimeter.

15. A building foundation comprising:

a plurality of insulating members arranged on a surface to define a perimeter, each insulating member comprising an insulating substance and having a vertical arm and a horizontal arm, wherein each arm has an elongated cross section defining major faces;

a concrete slab disposed within the perimeter; and gravel disposed between the plurality of insulating members and the concrete slab.

16. The building foundation of claim 15, further comprising:

flowable fill disposed beneath the plurality of insulating members;

structural fill beneath the flowable fill; and rigid insulation disposed adjacent to the flowable fill, extending beyond the perimeter.

17. The building foundation of claim 15, wherein the insulating substance comprises a foam.

18. The building foundation of claim 15, further comprising a vapor barrier disposed between the insulating members and the concrete slab.

19. A building foundation comprising:

a plurality of insulating members arranged on a surface to define a perimeter, each insulating member comprising an insulating substance and having a vertical arm and a horizontal arm, wherein each arm has an elongated cross section defining major faces;

flowable fill disposed beneath the plurality of insulating members;

structural fill beneath the flowable fill;

rigid insulation disposed adjacent to the flowable fill, extending beyond the perimeter; and a concrete slab disposed within the perimeter.

20. The building foundation of claim 19, wherein the insulating substance comprises a foam.

* * * * *